US011905699B2

(12) United States Patent
Soivio

(10) Patent No.: US 11,905,699 B2
(45) Date of Patent: Feb. 20, 2024

(54) METHOD AND ARRANGEMENT FOR SUPPORTING A FIRST BEAM BETWEEN A FIRST AND A SECOND SUPPORT STRUCTURE IN A BUILDING FRAME STRUCTURE

(71) Applicant: PEIKKO GROUP OY, Lahti (FI)

(72) Inventor: Jaakko Soivio, Lahti (FI)

(73) Assignee: PEIKKO GROUP OY, Lahti (FI)

( * ) Notice: Subject to any disclaimer, the term of this patent is extended or adjusted under 35 U.S.C. 154(b) by 365 days.

(21) Appl. No.: 17/298,701

(22) PCT Filed: Nov. 27, 2019

(86) PCT No.: PCT/FI2019/050845
§ 371 (c)(1),
(2) Date: Jun. 1, 2021

(87) PCT Pub. No.: WO2020/109663
PCT Pub. Date: Jun. 4, 2020

(65) Prior Publication Data

US 2022/0049490 A1 Feb. 17, 2022

(30) Foreign Application Priority Data

Nov. 29, 2018 (FI) ..... 20186014

(51) Int. Cl.
*E04B 1/24* (2006.01)
*E04B 1/30* (2006.01)

(52) U.S. Cl.
CPC ..... *E04B 1/2403* (2013.01); *E04B 1/30* (2013.01); *E04B 2001/2409* (2013.01); *E04B 2001/2418* (2013.01); *E04B 2001/2442* (2013.01)

(58) Field of Classification Search
CPC .. E04B 1/2403; E04B 1/30; E04B 2001/2409; E04B 2001/2418; E04B 2001/2442
See application file for complete search history.

(56) References Cited

U.S. PATENT DOCUMENTS 3,977,801 A * 8/1976 Murphy ..... E04B 1/2403 248/225.11
4,711,593 A 12/1987 Wilhelmi
(Continued)

FOREIGN PATENT DOCUMENTS

EP 2 468 986 A2 6/2012
KR 101880490 B1 7/2018
(Continued)

OTHER PUBLICATIONS

Jul. 5, 2019 Office Action issued in Finnish Patent Application No. 20186014.
(Continued)

*Primary Examiner* — Christine T Cajilig
(74) *Attorney, Agent, or Firm* — Oliff PLC

(57) ABSTRACT

A method and an arrangement for supporting a first beam between a first support structure and a second support structure in a building frame structure. The method includes securing the first beam to a first console against movement along the first console by means of a mechanical joint between the first console and the first beam, and the first console at a location between the beam supporting surface of the first console and the mechanical joint with a deforming section having increased deformability compared to the deformability of the first console at the beam supporting surface by reduced material dimensions in said deforming section of the first console compared to the material dimensions of the first console at the beam supporting surface.

26 Claims, 16 Drawing Sheets

(56) References Cited

U.S. PATENT DOCUMENTS

| | | | | | |
|---|---|---|---|---|---|
| 4,903,448 | A * | 2/1990 | Compton | E04B 1/215 | 52/250 |
| 5,061,111 | A * | 10/1991 | Hosokawa | E04C 3/36 | 403/187 |
| 5,253,945 | A * | 10/1993 | Hosokawa | E04C 3/38 | 403/258 |
| 5,577,856 | A * | 11/1996 | Tezuka | E04B 1/2604 | 403/294 |
| 2004/0244330 | A1 * | 12/2004 | Takeuchi | E04H 9/024 | 52/831 |
| 2007/0039279 | A1 * | 2/2007 | Zambelli | E04B 1/215 | 52/698 |

FOREIGN PATENT DOCUMENTS

| | | | | |
|---|---|---|---|---|
| NL | 2000955 | C1 | 4/2009 | |
| WO | WO-2019107696 | A1 * | 6/2019 | E04B 1/2403 |

OTHER PUBLICATIONS

Feb. 20, 2020 International Search Report issued in International Patent Application No. PCT/FI2019/050845.

Figure 4:
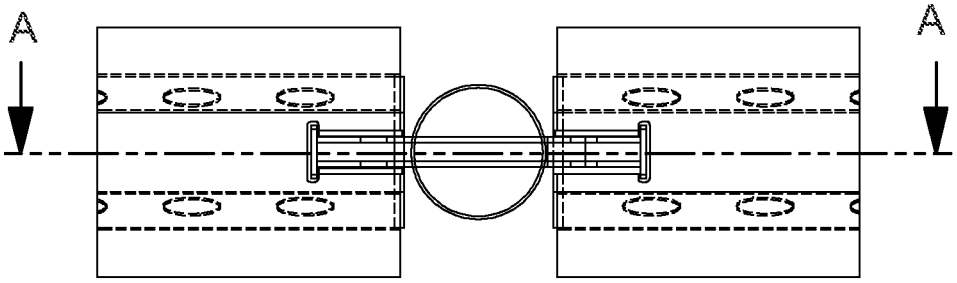

* cited by examiner (A-A FIG 4)

(B-B FIG 34:)

(C-C FIG 39:)

METHOD AND ARRANGEMENT FOR SUPPORTING A FIRST BEAM BETWEEN A FIRST AND A SECOND SUPPORT STRUCTURE IN A BUILDING FRAME STRUCTURE

FIELD OF THE INVENTION

The invention relates to a method for supporting a first beam between a first support structure and a second support structure in a building frame structure as defined in the preamble of independent claim 1.

The invention also relates to an arrangement for supporting a first beam between a first support structure and a second support structure in a building frame structure as defined in the preamble of independent claim 14.

OBJECTIVE OF THE INVENTION

The object of the invention is to provide a method and an arrangement for supporting a first beam between a first support structure and a second support structure in a building frame structure capable of at least partly of supporting a first end of the first beam at the first supporting structure also in a situation where the support for the opposite second end of the first beam for some reason is lost for example as a consequence of the second supporting structure being damaged.

Short Description of the Invention

The method is characterized by the definitions of independent claim 1.

Preferred embodiments of the method are defined in the dependent claims 2 to 13.

The arrangement is correspondingly characterized by the definitions of independent claim 14.

Preferred embodiments of the arrangement are defined in the dependent claims 15 to 26.

LIST OF FIGURES

Figure 1:
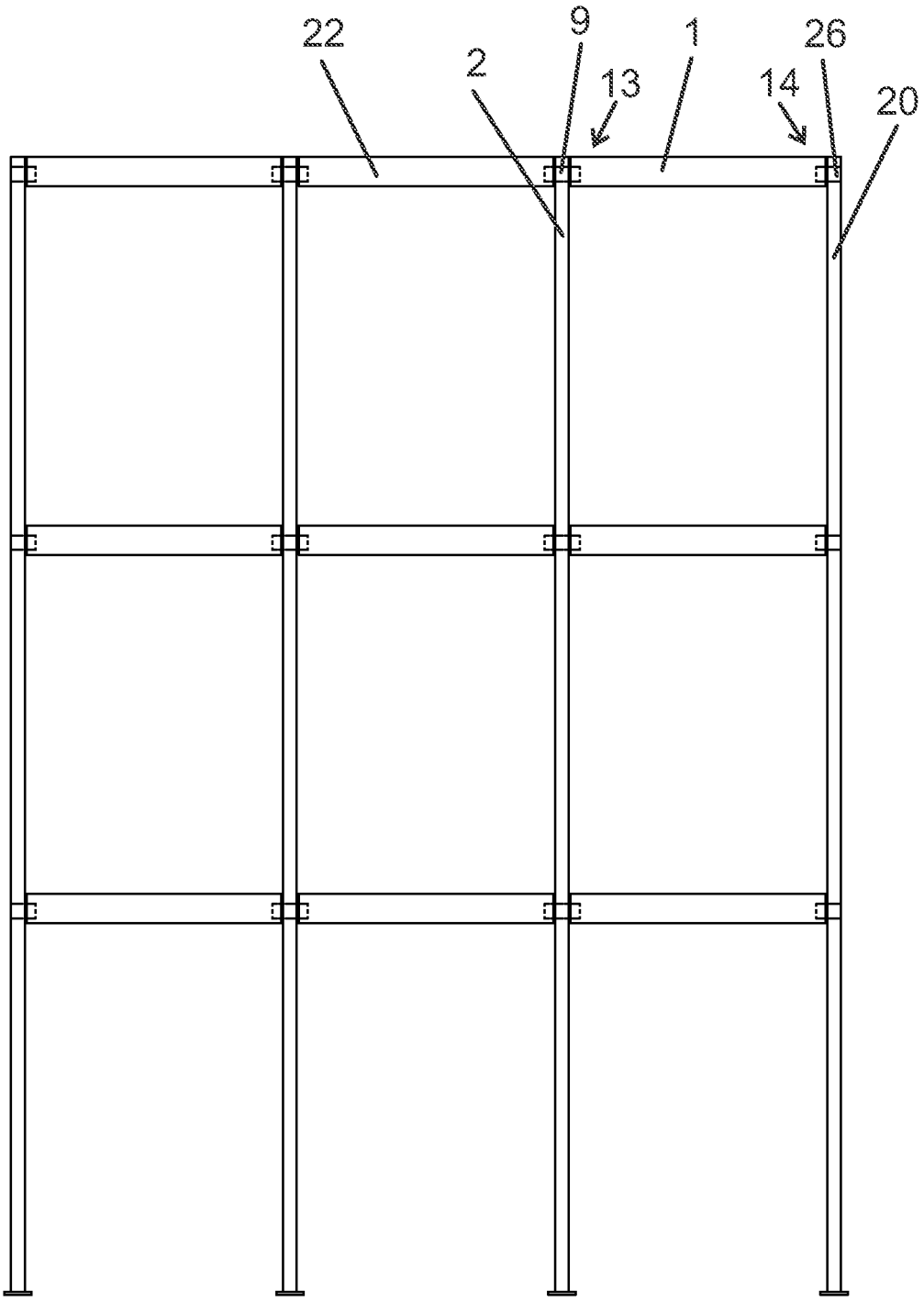
Figure 2:
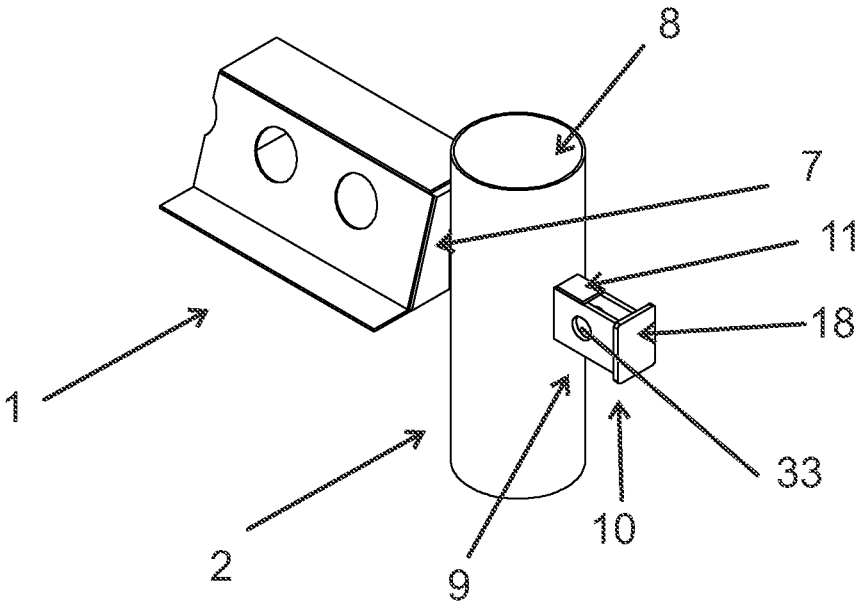
Figure 3:
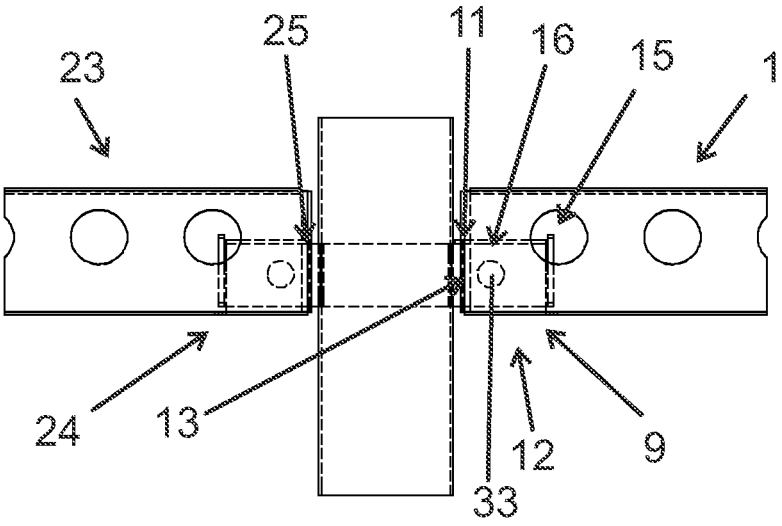
Figure 5:
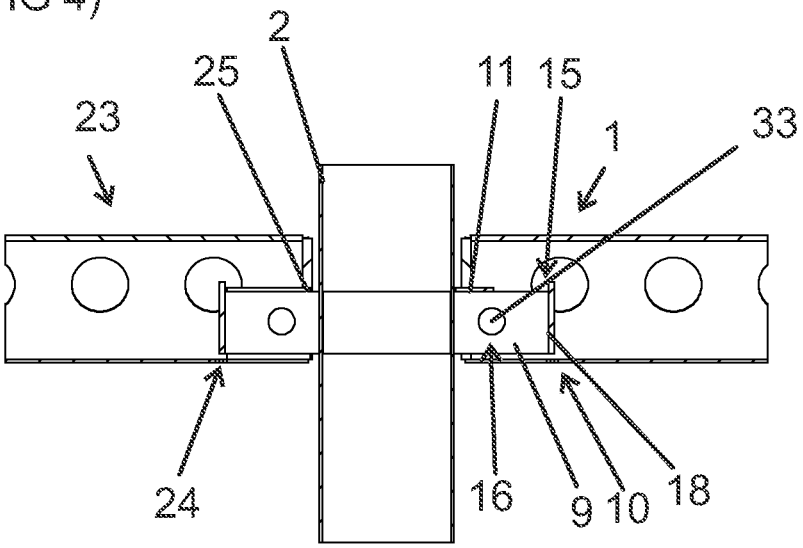
Figure 6:
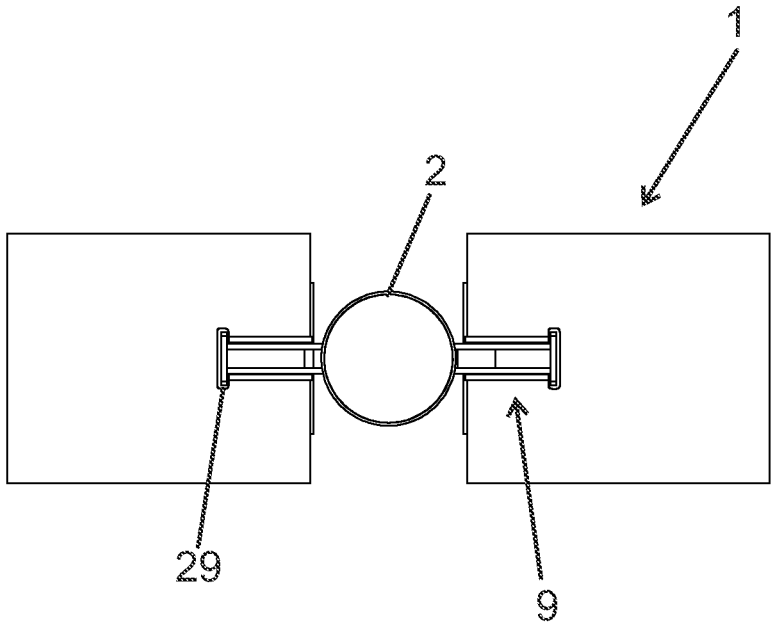
Figure 7:
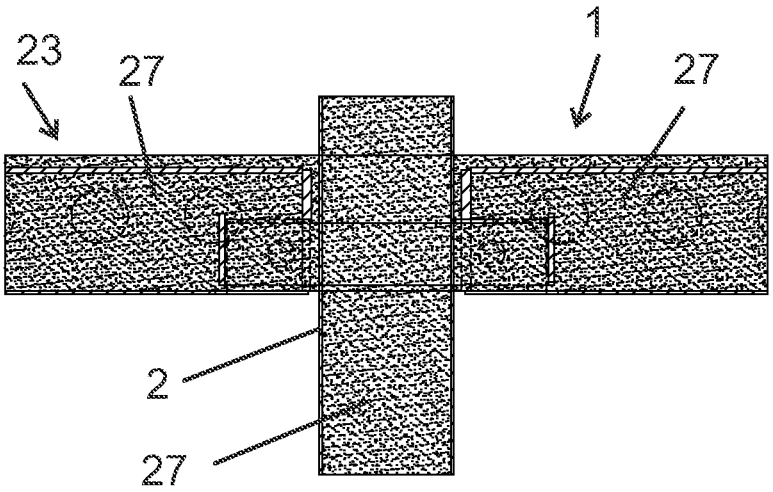
Figure 8:
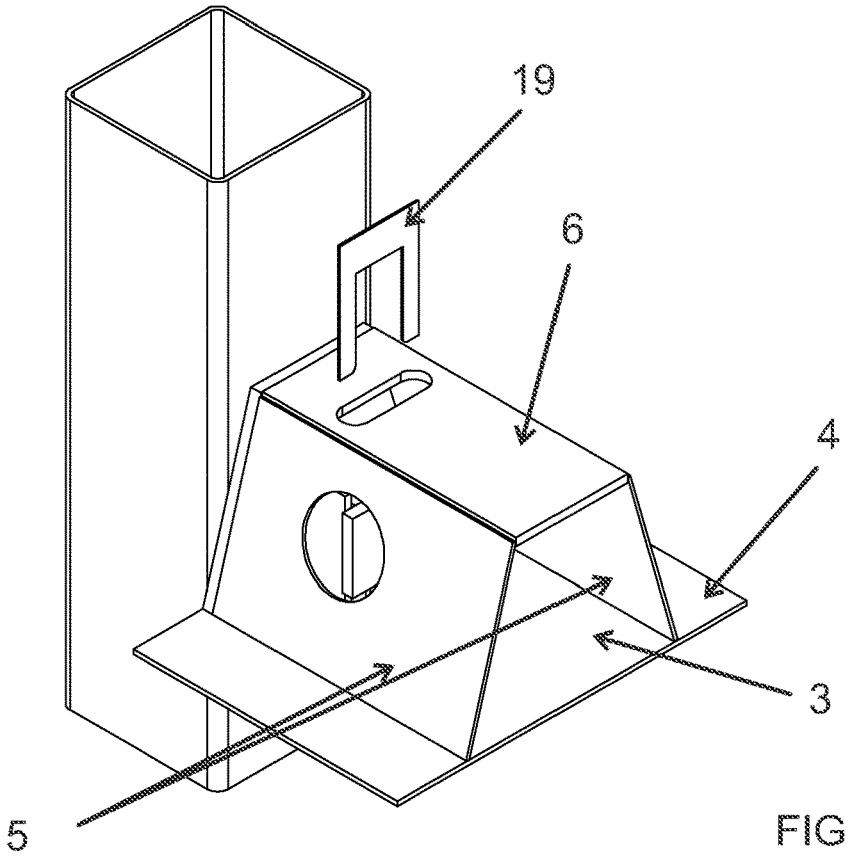
Figure 9:
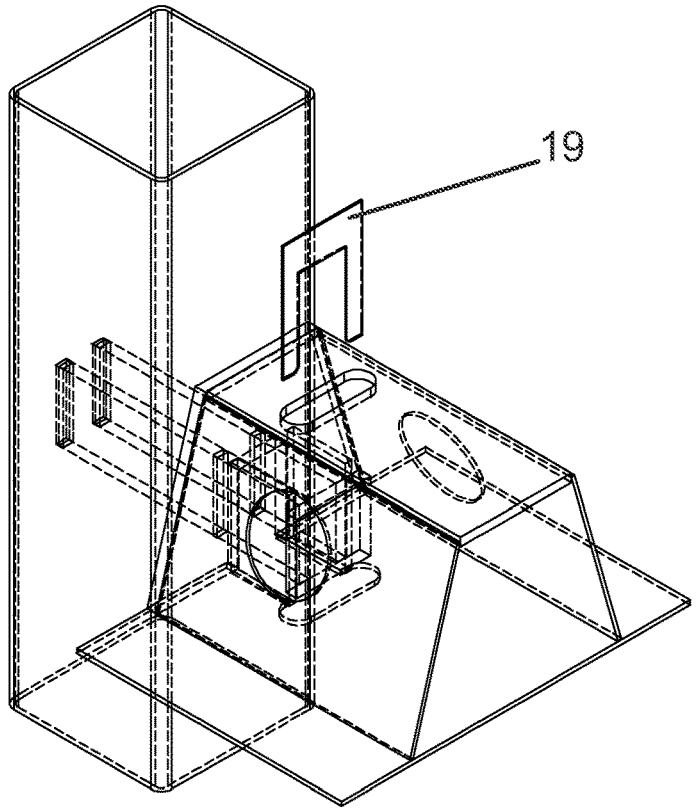
Figure 10:
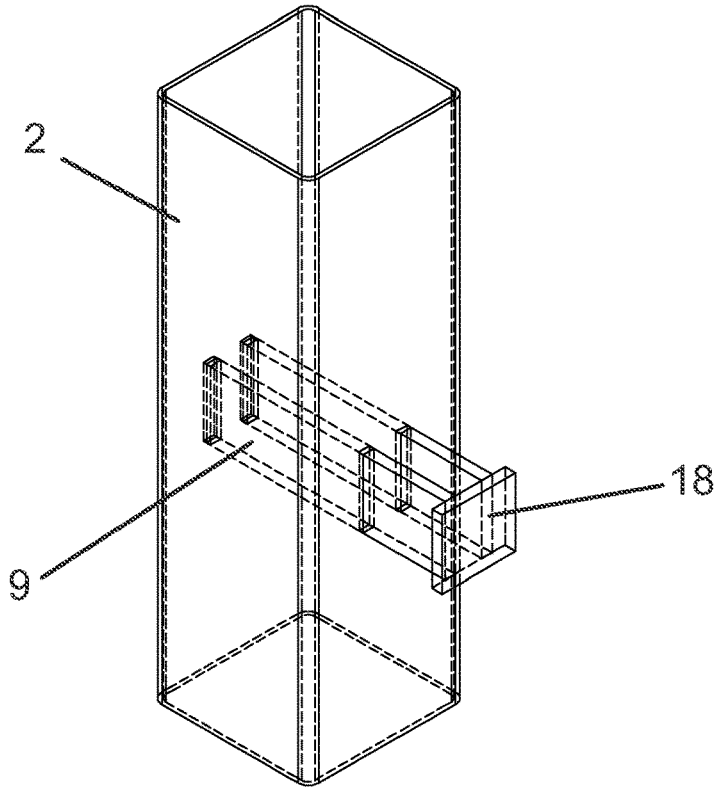
Figure 11:
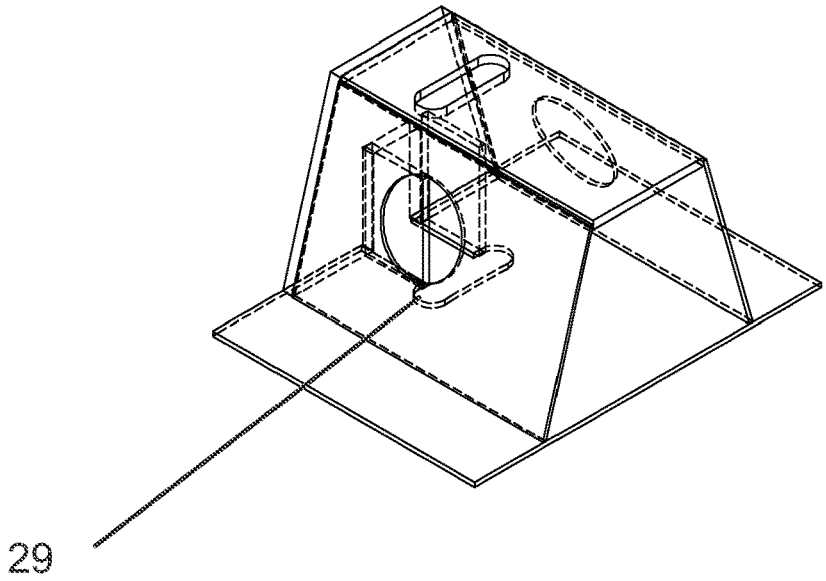
Figure 12:
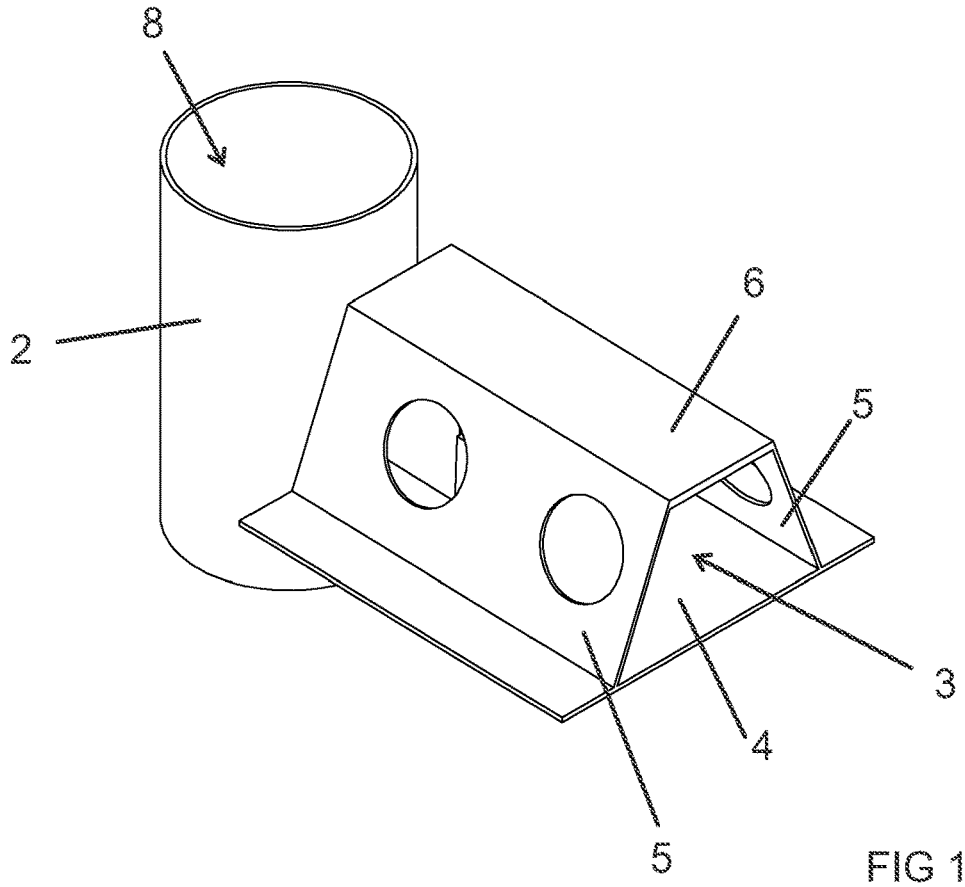
Figure 13:
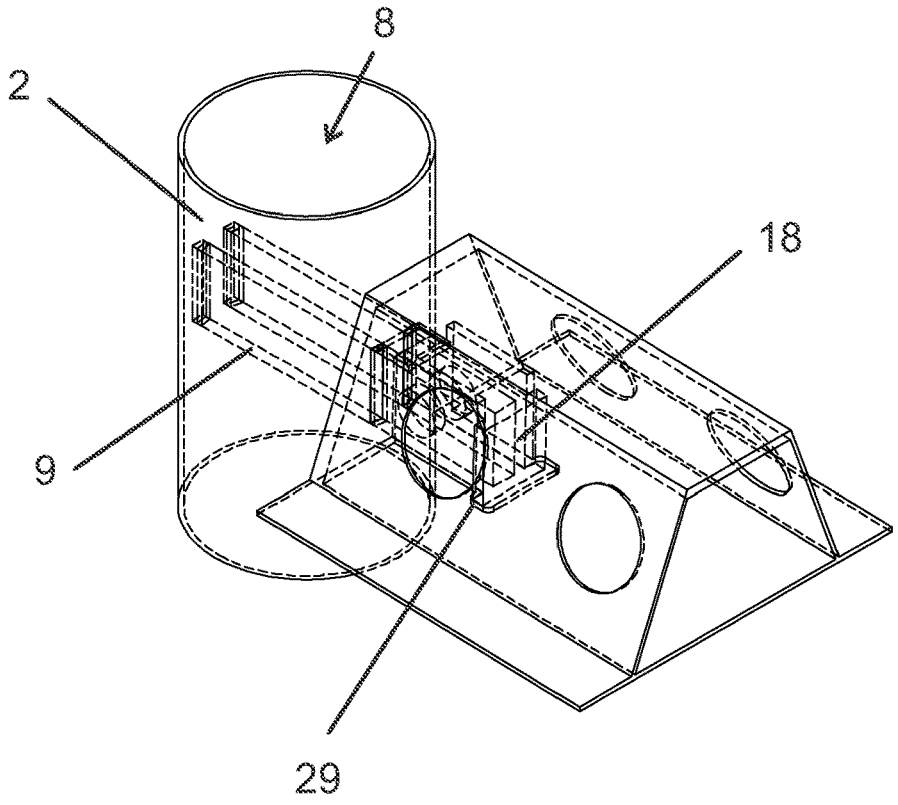
Figure 14:
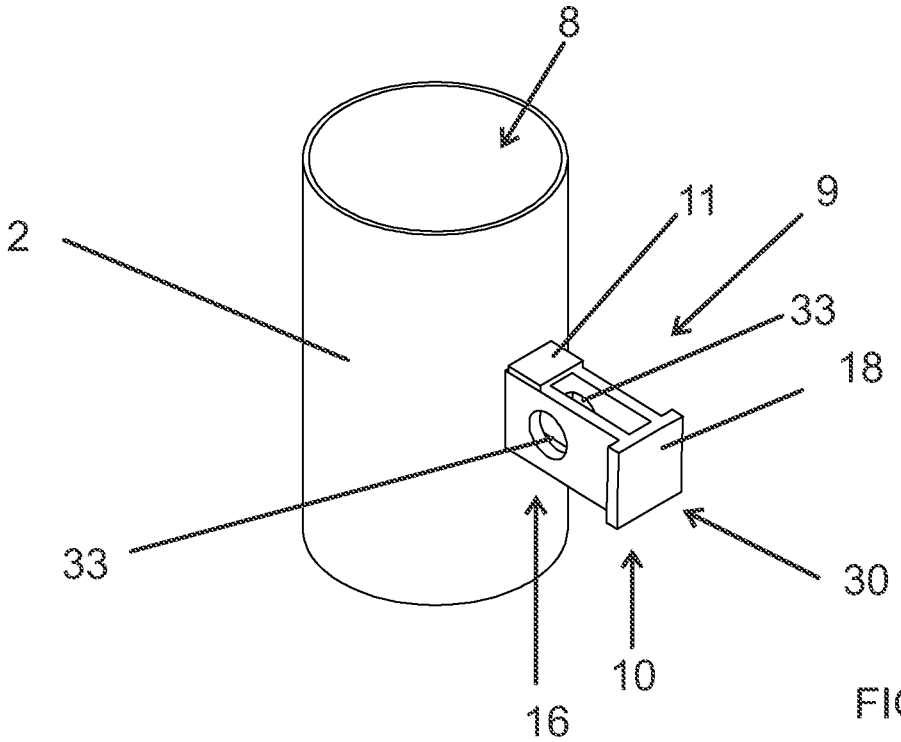
Figure 15:
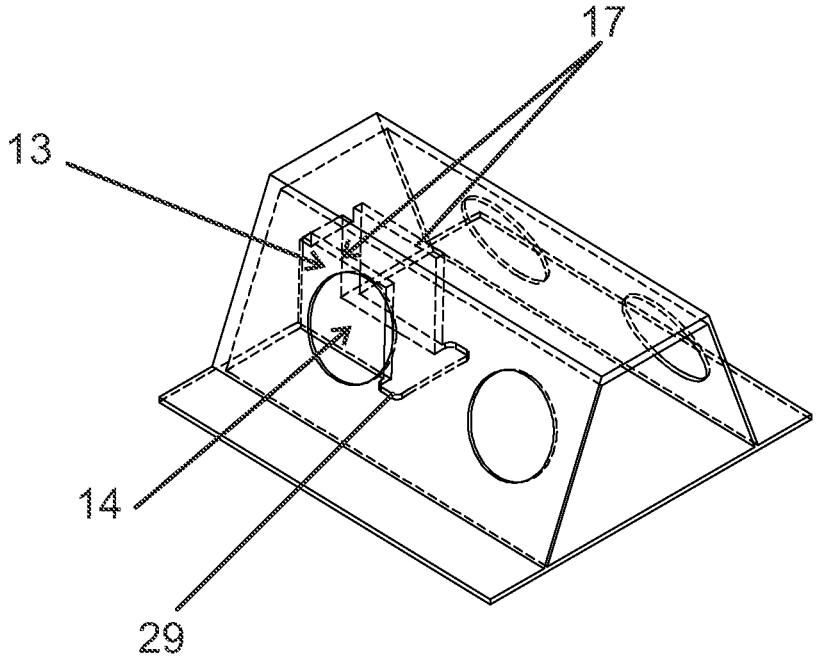
Figure 16:
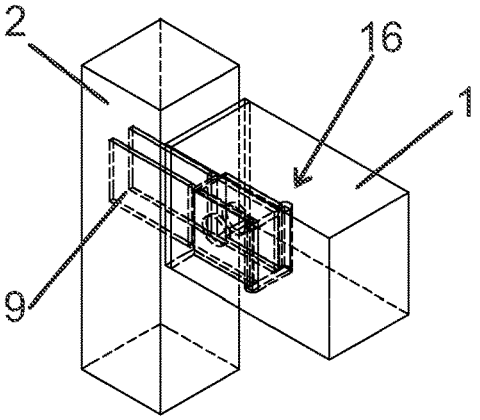
Figure 17:
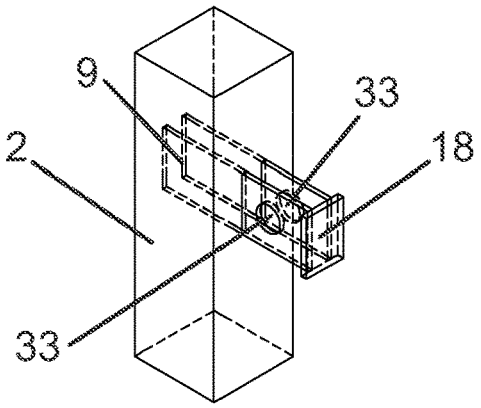
Figure 18:
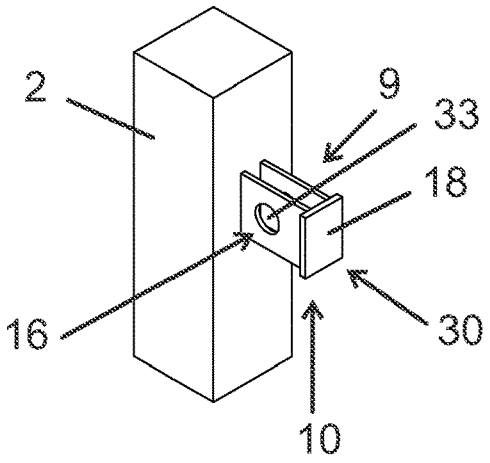
Figure 19:
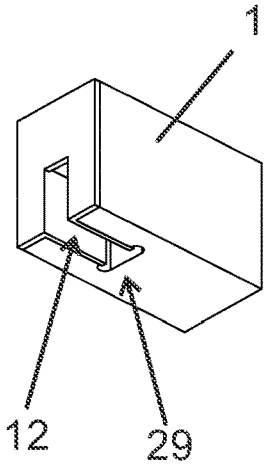
Figure 20:
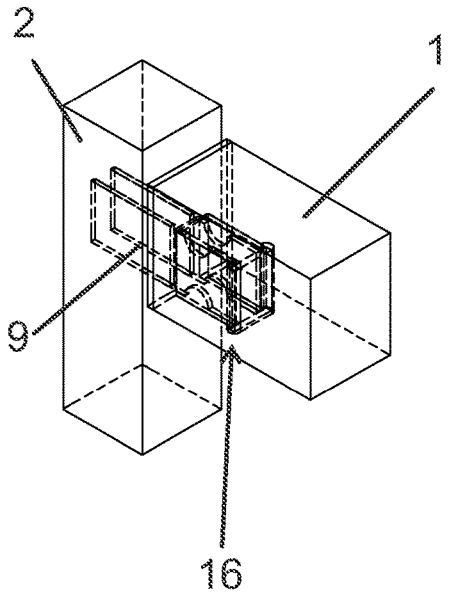
Figure 21:
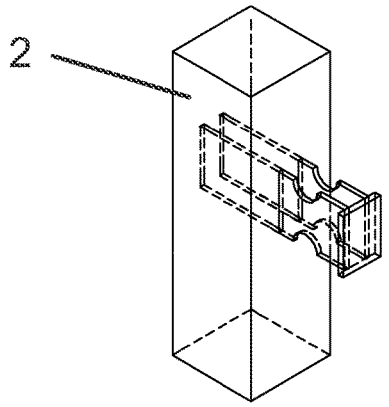
Figure 22:
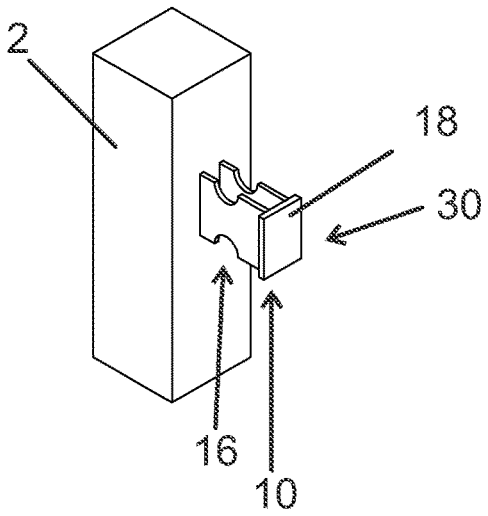
Figure 23:
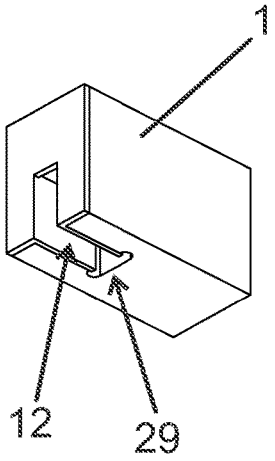
Figure 24:
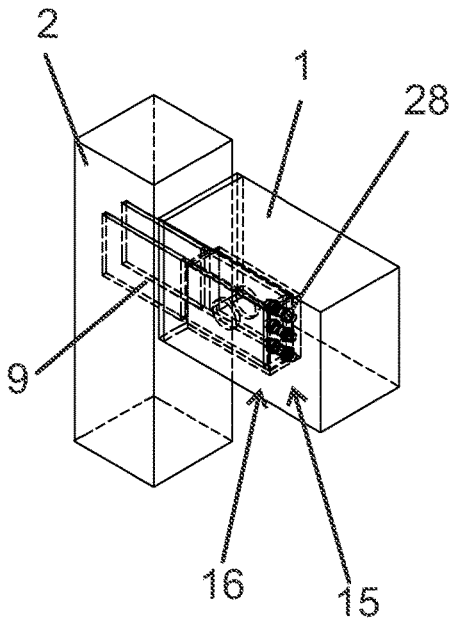
Figure 25:
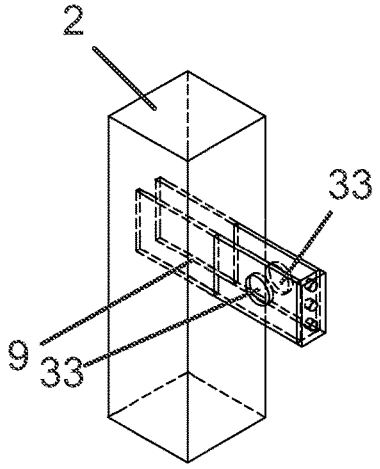
Figure 26:
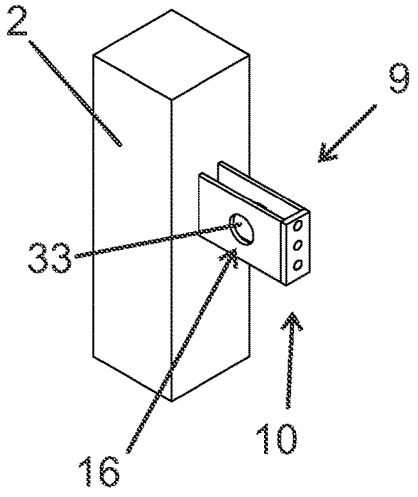
Figure 27:
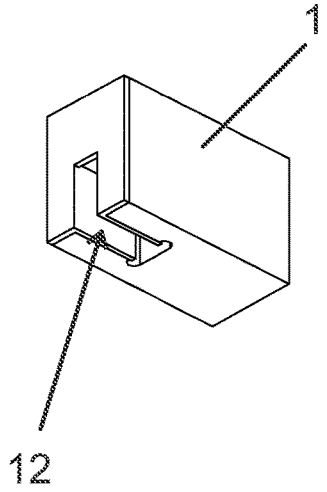
Figure 28:
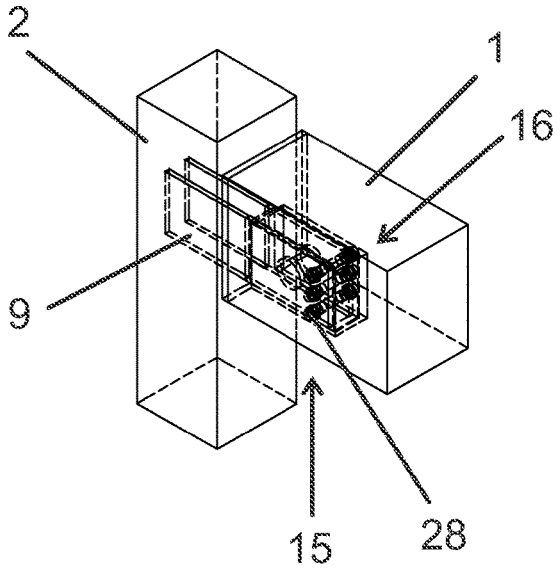
Figure 29:
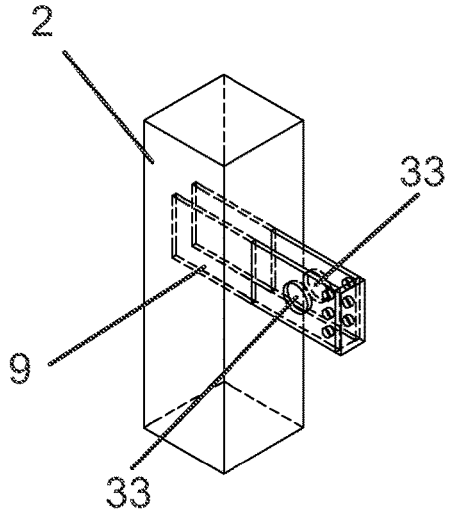
Figure 30:
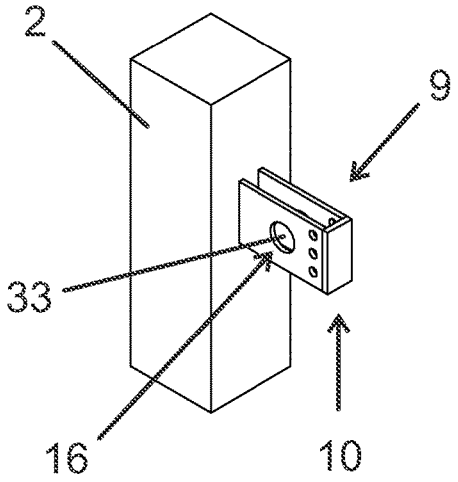
Figure 31:
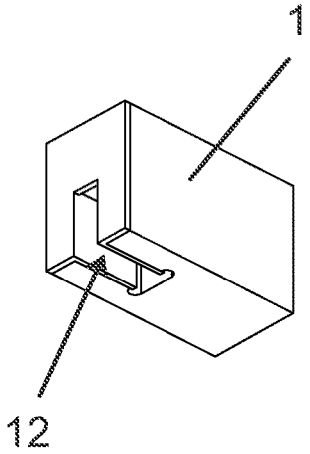
Figure 32:
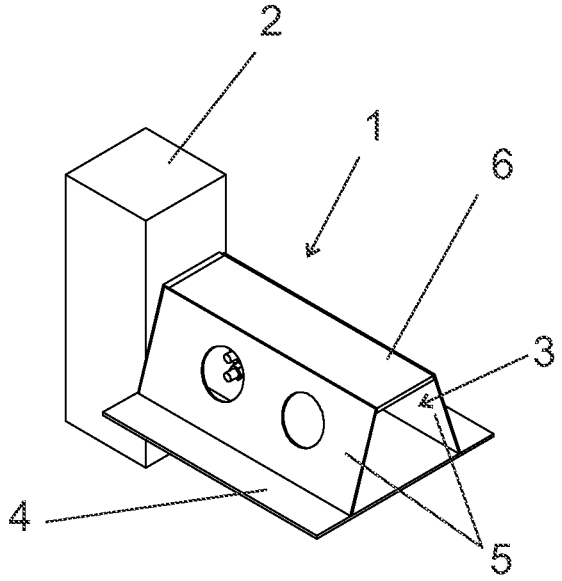
Figure 33:
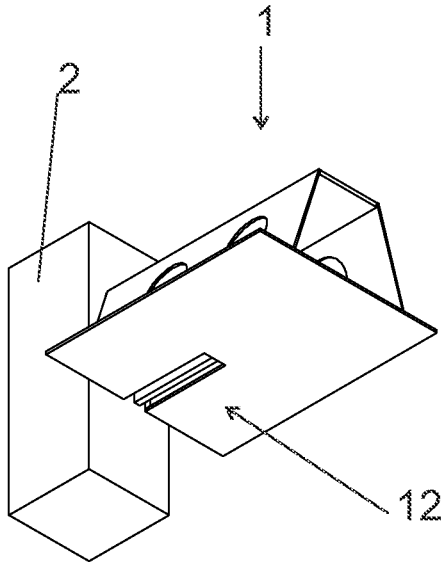
Figure 34:
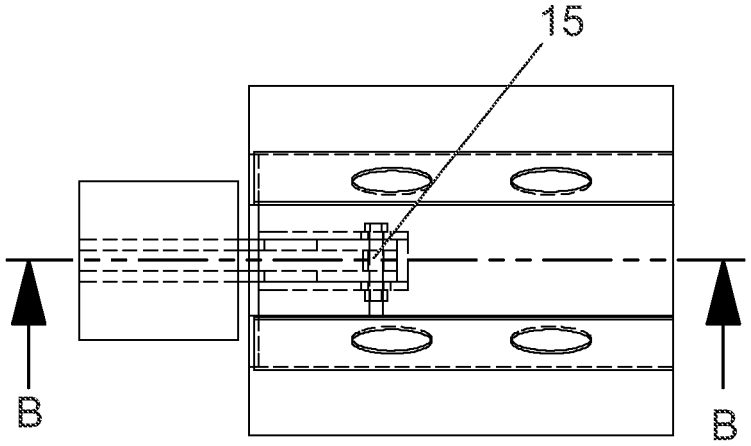
Figure 35:
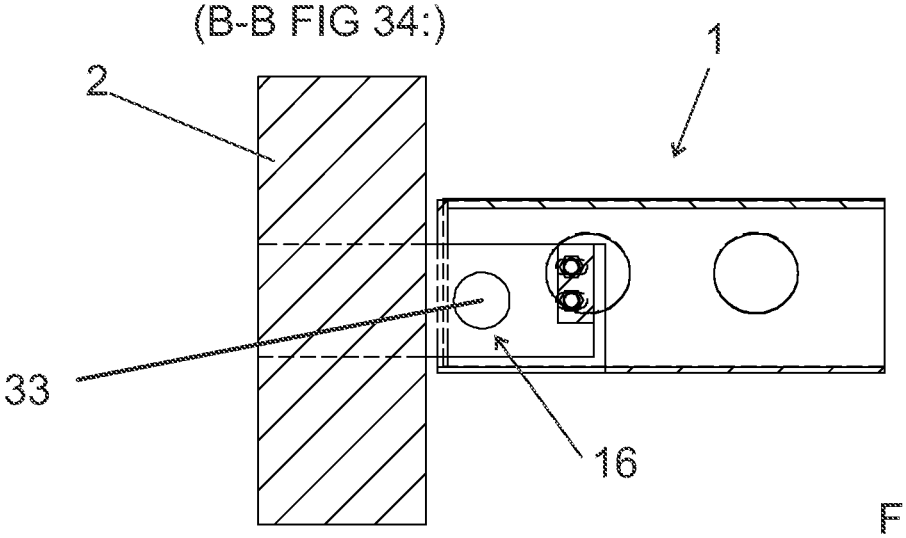
Figure 36:
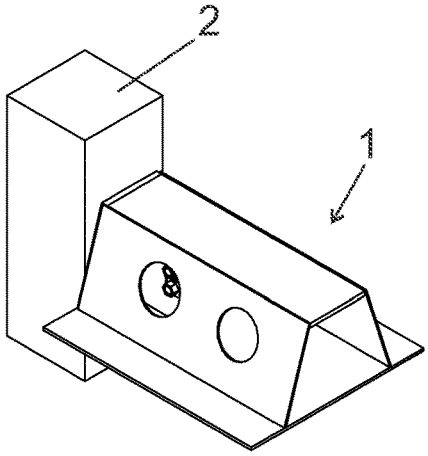
Figure 37:
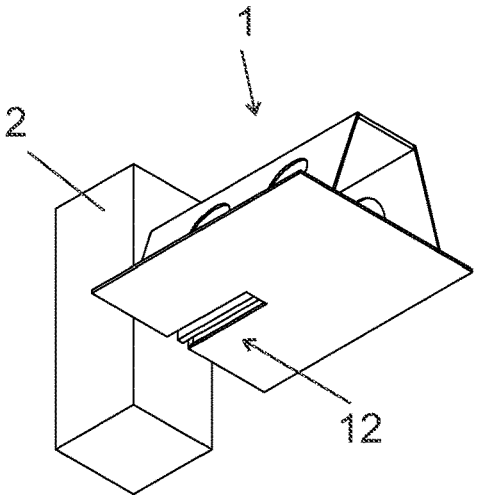
Figure 38:
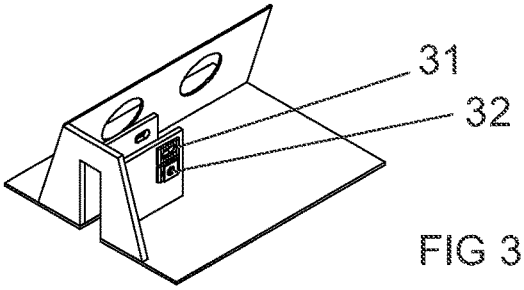
Figure 39:
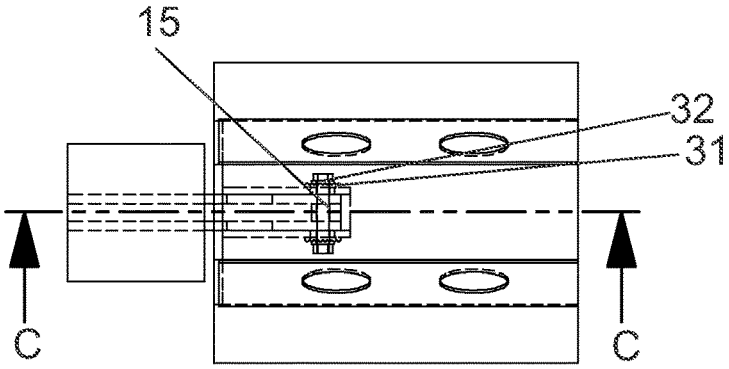
Figure 40:
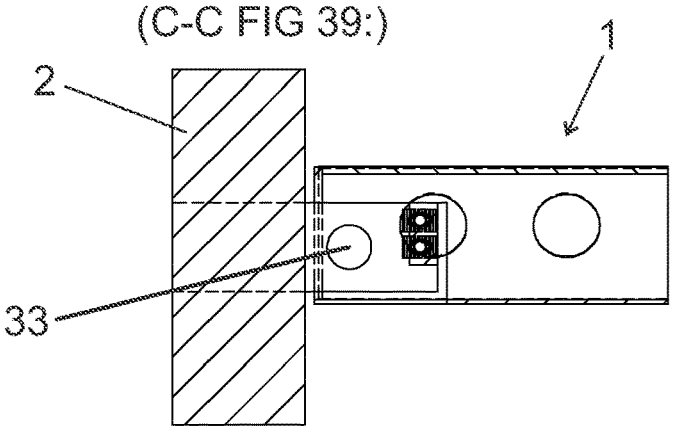
Figure 41:
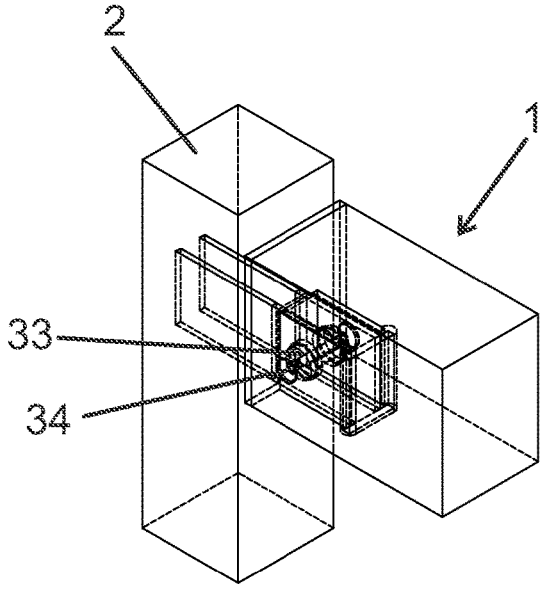
Figure 42:
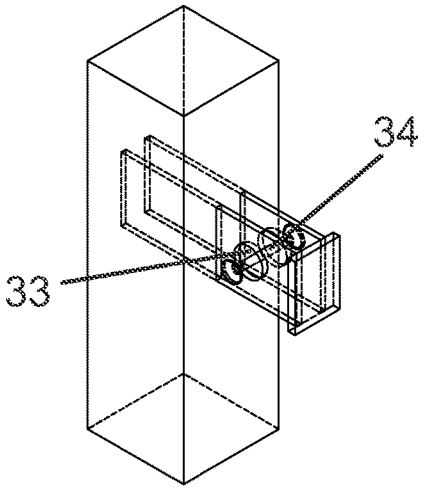
Figure 43:
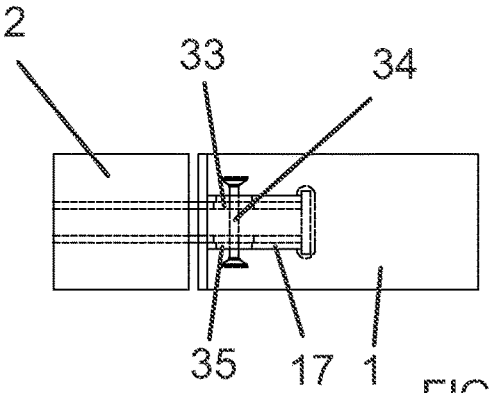
Figure 44:
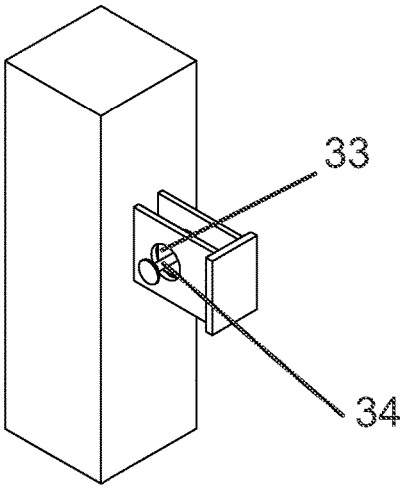
Figure 45:
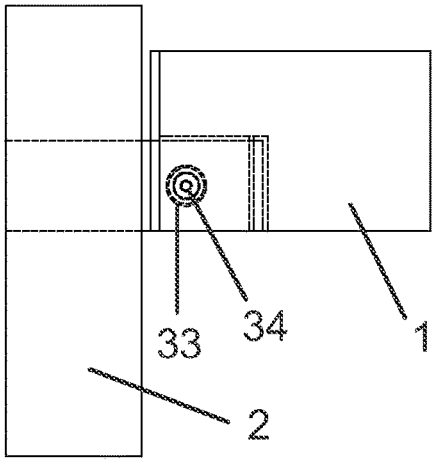
Figure 46:
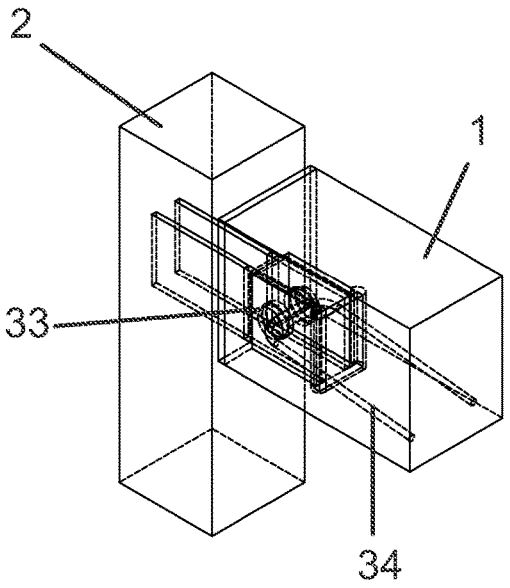
Figure 47:
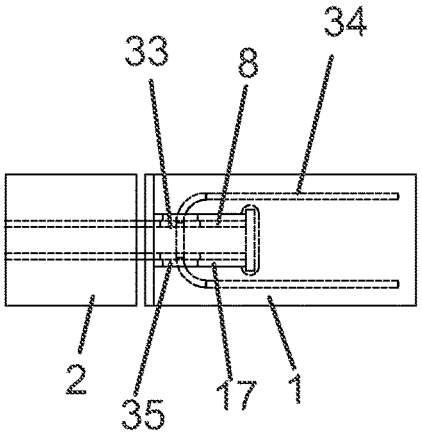
Figure 48:
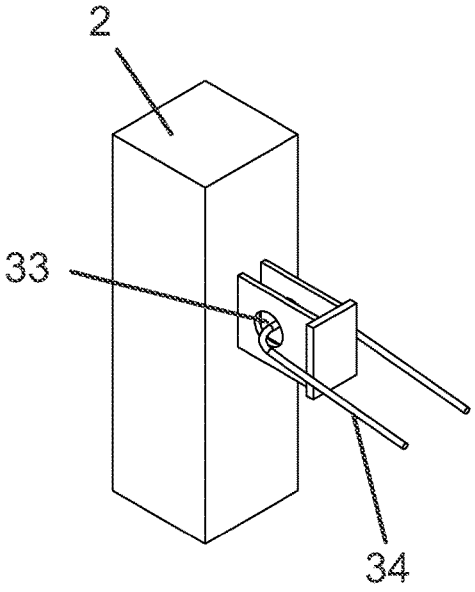
Figure 49:
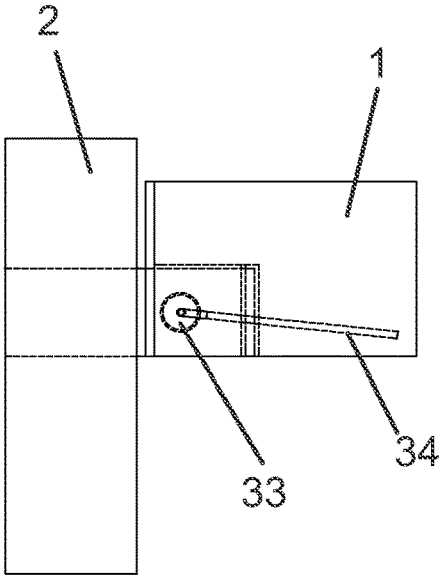

In the following the invention will described in more detail by referring to the figures, which FIG. 1 shows a building frame structure, FIG. 2 shows in greater detail a connection between a first beam and a first support structure in a building frame structure, FIG. 3 shows in greater detail and in partly transparent view a first beam and a second beam supported at a first support structure in a building frame structure, FIG. 4 shows the detail shown in FIG. 3 from above in transparent view, FIG. 5 shows the detail shown in FIG. 3 in section view as cut along plane A-A in FIG. 4, FIG. 6 shows the detail shown in FIG. 3 from below, FIG. 7 shows in greater detail and in partly transparent view a first beam and a second beam supported at a first support structure in a building frame structure, FIG. 8 shows in greater detail and in partly exploded view a first beam supported at a first support structure in a building frame structure, FIG. 9 shows the detail shown in FIG. 8 in transparent view, FIG. 10 shows a detail of the connection shown in FIG. 9 in transparent view, FIG. 11 shows a detail of the connection shown in FIG. 9 in transparent view, FIG. 12 shows in greater detail a first beam supported at a first support structure in a building frame structure, FIG. 13 shows the detail shown in FIG. 13 in transparent view, FIG. 14 shows a detail of the connection shown in FIG. 12, FIG. 15 shows a detail of the connection shown in FIG. 12 in transparent view, FIG. 16 shows in partly transparent view a connection between a first beam and a first support structure in a building frame structure, FIG. 17 shows in partly transparent view a detail of the connection shown in FIG. 16, FIG. 18 shows a detail of the connection shown in FIG. 16, FIG. 19 shows a detail of the connection shown in FIG. 16, FIG. 20 shows in partly transparent view a connection between a first beam and a first support structure in a building frame structure, FIG. 21 shows in partly transparent view a detail of the connection shown in FIG. 20, FIG. 22 shows a detail of the connection shown in FIG. 20, FIG. 23 shows a detail of the connection shown in FIG. 20, FIG. 24 shows in partly transparent view a connection between a first beam and a first support structure in a building frame structure, FIG. 25 shows in partly transparent view a detail of the connection shown in FIG. 24, FIG. 26 shows a detail of the connection shown in FIG. 24, FIG. 27 shows a detail of the connection shown in FIG. 24, FIG. 28 shows in partly transparent view a connection between a first beam and a first support structure in a building frame structure, FIG. 29 shows in partly transparent view a detail of the connection shown in FIG. 28, FIG. 30 shows a detail of the connection shown in FIG. 28, FIG. 31 shows a detail of the connection shown in FIG. 28, FIGS. 32 to 35 shows an embodiment of connection between a first beam and a first support structure in a building frame structure that essentially corresponds to the embodiment illustrated in FIGS. 28 to 31 with the exception that the first beam is a hollow steel beam having an inner space configured to be filled with concrete, FIGS. 36 to 40 shows an embodiment of connection between a first beam and a first support structure in a building frame structure that essentially corresponds to the embodiment illustrated in FIGS. 23 to 35 with the exception that serrated plates and washers are used in the mechanical joint between the first console and the first beam, FIG. 41 shows in partly transparent view a connection between a first beam and a first support structure in a building frame structure, FIG. 42 shows in partly transparent view a detail of the connection shown in FIG. 41, FIG. 43 shows in partly transparent view a detail of the connection shown in FIG. 41, FIG. 44 shows in a detail of the connection shown in FIG. 41, FIG. 45 shows in partly transparent view a detail of the connection shown in FIG. 41, FIG. 46 shows in partly transparent view a connection between a first beam and a first support structure in a building frame structure, FIG. 47 shows in partly transparent view a detail of the connection shown in FIG. 46, FIG. 48 shows in a detail of the connection shown in FIG. 46, and FIG. 49 shows in partly transparent view a detail of the connection shown in FIG. 46.

DETAILED DESCRIPTION OF THE INVENTION

First the method for supporting a first beam 1 between a first support structure 2 and a second support structure 20 in a building frame structure and some embodiments and variants of the method will be describe in greater detail.

The method comprises providing a first console 9 to extend from the inside of the first support structure 2 to the outside of the first support structure 2 so that the first console 9 has a first free end 10 and a beam supporting surface 11 between the first support structure 2 and the first free end 10 of the first console 9. The first console 9 can extend through the first support structure 2 so that the first console 9 in addition to the first free end 10 has a second free end 24 and a second beam supporting surface as illustrated in the embodiments shown in FIGS. 2 to 7.

The method comprises providing the first beam 1 with a supporting slot 12 extending from a first end 13 of the first beam 1 at a lower side of the first beam 1.

The method comprises supporting the first end 13 of the first beam 1 at the first console 9 so that the first console 9 is partly is received in the supporting slot 12 of the first beam 1 and so that the of the first beam 1 is supported on the beam supporting surface 11 of the first console 9.

The method comprises supporting a second end 14 of the first beam 1 at the second support structure 20.

The method comprises securing the first beam 1 to the first console 9 against movement along the first console 9 by means of a mechanical joint 15 between the first console 9 and the first beam 1.

The method comprises providing the first console 9 at a location between the beam supporting surface 11 of the first console 9 and the mechanical joint 15 with a deforming section 16 having increased deformability compared to the deformability of the first console 9 at the beam supporting surface 11 by providing reduced material dimensions in said deforming section 16 of the first console 9 compared to the material dimensions of the first console 9 at the beam supporting surface 11.

Because the first beam 1 is secured to the first console 9 against movement along the first console 9 by the mechanical joint 15 and because of the provision of the deforming section 16, the first end 13 of the first beam 1 can remain attached to the first console 9 in a situation where the support of the second end 14 of the first beam 1 at the second support structure 20 is lost. More precisely, the deforming section 16 enables for movements between the first support structure 2 and the first beam 1 so that the first beam 1 can remain attached to the first console 9 and so that movements between the first support structure 2 and the first beam 1 does not damage the first support structure 2.

The first support structure 2 is preferably, but not necessarily, a column such as a pre-cast concrete column, a steel column, a hollow steel column, or a steel-concrete-composite column.

In one embodiment of the invention, such as in the embodiments illustrates in FIGS. 2 to 15, the first support structure 2 is a hollow column having a vertical inner space 8. This embodiment comprises preferably, but not necessarily filling the vertical inner space 8 of the first support structure 2 with concrete 27 to form a steel-concrete composite column of the first support structure 2 and of concrete 27, as shown in FIG. 7.

The first beam 1 is preferably, but not necessarily, a precast concrete beam, a steel beam, a steel-concrete composite beam, or a hollow steel beam having a horizontal inner space 3. In case the first beam 1 is a hollow steel beam having a horizontal inner space 3, such as in the embodiments illustrates in FIGS. 2 to 15, the method can comprise a step for filling the horizontal inner space 3 of the first beam 1 with concrete 27 to form a steel-concrete composite beam of the first beam 1 and of concrete 27, as shown in FIG. 7.

In one embodiment of the method, such as in the embodiments illustrated in FIGS. 2 to 15, the first beam 1 is a hollow steel beam having a horizontal inner space 3, wherein the horizontal inner space 3 is limited by a base plate 4, two web parts 5, a top plate 6, and a beam end plate 7 at each of a first end 13 and a second end 14 of the first beam 1. In this embodiment of the method, the supporting slot 12 forms a first slot section 21 in the beam end plate 7 and a second slot section 22 in the base plate 4. This embodiment of the method can comprise providing the supporting slot 12 with vertical side plates 17 inside the horizontal inner space 3 of the first beam 1 to laterally limit the supporting slot 12 inside the horizontal inner space 3 of the first beam 1, wherein the vertical side plates 17 are fastened to the first beam 1. This embodiment of the method can comprise providing the first free end 10 of the first console 9 with a console end plate 18, supporting the beam end plate 7 of the first beam 1 on the beam supporting surface 11 of the first console 9, and dimensioning the console end plate 18 so that the console end plate 18 extends in the transversal direction of the first beam 1 beyond the vertical side plates 17 so that the vertical side plates 17 together with the console end plate 18 form at least a part of said mechanical joint 15 between the beam supporting surface 11 and the first free end 10 of the first console 9. This embodiment of the method can comprise arranging a shim plate 19 at least partly between the console end plate 18 and the vertical side plates 17 to reduce a possible gap (not marked with a reference numeral) between the console end plate 18 and the vertical side plates 17.

The method can comprise securing the first beam 1 to the first console 9 against movement along the first console 9 by means of a mechanical joint 15 by providing the supporting slot 12 with an indentation 29 and by providing the first console 9 with a protrusion 30 that extends from the first console 9 into the indentation 29 of the supporting slot 12. In such case, the method can comprise providing the protrusion 30 by providing the first free end 10 of the first console 9 with a console end plate 18 that extends in the transversal direction of the first console 9 beyond the first console 9, and comprise providing the indentation 29 of the supporting slot 12 at the end of the supporting slot 12 so that the indentation 29 extend in the transversal direction of the first beam 1 in two opposite directions.

The method can comprise using external fastening means 28 such as bolts in the mechanical joint 15 to the first console 9 against movement along the first console 9 as illustrated in the embodiments shown in FIGS. 24 to 40. In the embodiment illustrated in FIGS. 36 to 40, serrated plates 31 attached to the vertical side plates 17 and serrated washers 32 are used in the mechanical joint 15 to make the joint between the first console 9 and the first beam 1 stronger.

The first console 9 that is provided can have having essentially the same outer cross section between the beam supporting surface 11 and the first free end 10 of the first console 9, and at least one first hole 33 can be provide in the first console 9 to reduce the material dimensions in first console 9 to provide the deforming section 16.

The first console 9 that is provided can have essentially the same outer cross section between the beam supporting surface 11 and the first free end 10 of the first console 9 except for the deforming section 16, where the first console 9 comprises at least one section with reduced cross-sectional area in at least one of an upper surface and a lower surface of the first console 9 to provide the deforming section 16. In such case, the deforming section 16 can additionally be provided with at least one first hole 33.

If the first console 9 is provided with at least one first hole 33, a reinforcement bar 34 can be arranged to pass through said at least one first hole 33, to provide an additional connection between the first console 8 and concrete of the first beam 1. In FIGS. 41 to 45, a reinforcement bar 34 having headed ends (not marked with a reference numeral) is provided and in FIGS. 46 to 49 a reinforcement bar 34 that is bent into a U-shape is provided.

If the supporting slot 12 is provided with vertical side plates 17 inside the horizontal inner space 3 of the first beam 1 to laterally limit the supporting slot 12 inside the horizontal inner space 3 of the first beam 1 so that the vertical side plates 17 are fastened to the first beam 1, the vertical side plates 17 can comprise second holes 35, which are aligned with the first holes 33 in the first console and a reinforcement bar 34 can be arranged to pass through both the first holes 33 and the second holes 35, to provide an additional connection between the first console 8 and the first beam 1, preferably concrete of the first beam 1, as shown in FIGS. 41 to 49.

Next the arrangement for supporting a first beam 1 between a first support structure 2 and a second support structure 20 in a building frame structure and some embodiments and variants of the arrangement will be described in greater detail.

The arrangement comprises a first console 9 extending from the inside of the first support structure 2 to the outside of the first support structure 2 so that the first console 9 has a first free end 10 and a beam supporting surface 11 between the first support structure 2 and the first free end 10 of the first console 9. The first console 9 can extend through the first support structure 2 so that the first console 9 in addition to the first free end 10 has a second free end 24 and a second beam supporting surface as illustrated in the embodiments shown in FIGS. 2 to 7.

The first beam 1 has a supporting slot 12 extending from a first end 13 of the first beam 1 at a lower side of the first beam 1.

The first end 13 of the first beam 1 is supported at the first console 9 so that the first console 9 is partly is received in the supporting slot 12 of the first beam 1 and so that the of the first beam 1 is supported on the beam supporting surface 11 of the first console 9.

A second end 14 of the first beam 1 is supported at the second support structure 20.

The second end 14 of the first beam 1 can have a similar configuration as the first end 13 of the first beam 1. Alternatively, the second end 14 of the first beam 1 can for example be provided with a flange (not shown in the figures) configured to form a fastening means for fastening the first beam 1 to another beam. It is also possible that the second end 14 of the first beam 1 is free of supporting slots.

The first beam 1 is secured to the first console 9 against movement along the first console 9 by means of a mechanical joint 15 between the first console 9 and the first beam 1.

The first console 9 is at a location between the beam supporting surface 11 of the first console 9 and the mechanical joint 15 provided with a deforming section 16 having increased deformability compared to the deformability of the first console 9 at the beam supporting surface 11 by reduced material dimensions being provided in said deforming section 16 of the first console 9 compared to the material dimensions of the first console 9 at the beam supporting surface 11.

Because the first beam 1 is secured to the first console 9 against movement along the first console 9 by the mechanical joint 15 and because of the provision of the deforming section 16, the first end 13 of the first beam 1 can remain attached to the first console 9 in a situation where the support of the second end 14 of the first beam 1 at the second support structure 20 is lost. More precisely, the deforming section 16 enables for movements between the first support structure 2 and the first beam 1 so that the first beam 1 can remain attached to the first console 9 and so that movements between the first support structure 2 and the first beam 1 does not damage the first support structure 2.

The first support structure 2 is preferably, but not necessarily, a column such as a pre-cast concrete column, a steel column, a hollow steel column, or a steel-concrete-composite column.

In one embodiment of the invention, such as in the embodiments illustrates in FIGS. 2 to 15, the first support structure 2 is a hollow column having a vertical inner space 8. This embodiment comprises preferably, but not necessarily filling the vertical inner space 8 of the first support structure 2 with concrete 27 to form a steel-concrete composite column of the first support structure 2 and of concrete 27, as illustrated in FIG. 7.

The first beam 1 is preferably, but not necessarily, a precast concrete beam, a steel beam, or a hollow steel beam having a horizontal inner space 3. In case the first beam 1 is a hollow steel beam having a horizontal inner space 3, such as in the embodiments illustrates in FIGS. 2 to 15, the method can comprise a step for filling the horizontal inner space 3 of the first beam 1 with concrete 27 to form a steel-concrete composite beam of the first beam 1 and of concrete 27, as illustrated in FIG. 7.

In one embodiment of the arrangement, such as in the embodiments illustrated in FIGS. 2 to 15, the first beam 1 is a hollow steel beam having a horizontal inner space 3, wherein the horizontal inner space 3 is limited by a base plate 4, two web parts 5, a top plate 6, and a beam end plate 7 at each of a first end 13 and a second end 14 of the first beam 1. In this embodiment of the method, the supporting slot 12 forms a first slot section 21 in the beam end plate 7 and a second slot section 22 in the base plate 4. This embodiment of the method can comprise providing the supporting slot 12 with vertical side plates 17 inside the horizontal inner space 3 of the first beam 1 to laterally limit the supporting slot 12 inside the horizontal inner space 3 of the first beam 1, wherein the vertical side plates 17 are fastened to the first beam 1. In this embodiment of the arrangement, the first free end 10 of the first console 9 can be provided with a console end plate 18, so that the beam end plate 7 of the first beam 1 is supported on the beam supporting surface 11 of the first console 9, and the console end plate 18 can be dimensioned so that the console end plate 18 extends in the transversal direction of the first beam 1 beyond the vertical side plates 17 so that the vertical side plates 17 together with the console end plate 18 form at least a part of said mechanical joint 15 between the beam supporting surface 11 and the first free end 10 of the first console 9. A shim plate 19 can be arranged at least partly between the console end plate 18 and the vertical side plates 17 to reduce clearance between the console end plate 18 and the vertical side plates 17.

In the arrangement, the first beam 1 can be secured to the first console 9 against movement along the first console 9 by means of a mechanical joint 15 comprising an indentation 29 in the supporting slot 12 and a protrusion 30 at the first console 9, wherein the protrusion 30 extends from the first console 9 into the indentation 29 of the supporting slot 12. In such case, the protrusion 30 can be providing the first free end 10 of the first console 9 in the form a console end plate 18 that extends in the transversal direction of the first console 9 beyond the first console 9, and the indentation 29 of the supporting slot 12 can be provided at the end of the supporting slot 12 so that the indentation 29 extend in the transversal direction of the first beam 1 in two opposite directions.

In the arrangement external fastening means 28 such as bolts can be used in the mechanical joint 15 to the first console 9 against movement along the first console 9 as illustrated in the embodiments shown in FIGS. 24 to 40. In the embodiment illustrated in FIGS. 36 to 40, serrated plates 31 attached to the vertical side plates 17 and serrated washers 32 are used in the mechanical joint 15 to make the joint between the first console 9 and the first beam 1 stronger.

The first console 9 can have having essentially the same outer cross section between the beam supporting surface 11 and the first free end 10 of the first console 9, and at least one first hole 33 can be provided in the first console 9 to reduce the material dimensions in first console 9 to provide the deforming section 16.

The first console 9 can have essentially the same outer cross section between the beam supporting surface 11 and the first free end 10 of the first console 9 except for the deforming section 16, where the first console 9 comprises at least one section with reduced cross-sectional area in at least one of an upper surface and a lower surface of the first console 9 to provide the deforming section 16. In such case, the deforming section 16 can additionally be provided with at least one first hole 33.

If the first console 9 is provided with at least one first hole 33, a reinforcement bar 34 can be arranged to pass through said at least one first hole 33, to provide an additional connection between the first console 8 and concrete of the first beam 1. In FIGS. 41 to 45, a reinforcement bar 34 having headed ends (not marked with a reference numeral) is provided and in FIGS. 46 to 49 a reinforcement bar 34 that is bent into a U-shape is provided.

If the supporting slot 12 is provided with vertical side plates 17 inside the horizontal inner space 3 of the first beam 1 to laterally limit the supporting slot 12 inside the horizontal inner space 3 of the first beam 1 so that the vertical side plates 17 are fastened to the first beam 1, the vertical side plates 17 can comprise second holes 35, which are aligned with the first holes 33 in the first console and a reinforcement bar 34 can be arranged to pass through both the first holes 33 and the second holes 35, to provide an additional connection between the first console 8 and the first beam 1, preferably concrete of the first beam 1, as shown in FIGS. 41 to 49.

It is apparent to a person skilled in the art that as technology advances, the basic idea of the invention can be implemented in various ways. The invention and its embodiments are therefore not restricted to the above examples, but they may vary within the scope of the claims.

LIST OF REFERENCE NUMERALS

1. First beam
2. First support structure
3. Horizontal inner space
4. Base plate
5. Web part
6. Top plate
7. Beam end plate
8. Vertical inner space
9. First console
10. First free end
11. Beam supporting surface
12. Supporting slot
13. First end
14. Second end
15. Mechanical joint
16. Deforming section
17. Vertical side plate
18. Console end plate
19. Shim plate
20. Second support structure
21. First slot section
22. Second slot section
23. Second beam
24. Second free end
25. Second beam supporting surface
26. Second console
27. Concrete
28. External fastening means
29. Indentation
30. Protrusion
31. Serrated plates
32. Serrated washers
33. First hole
34. Reinforcement bar
35. Second hole

The invention claimed is:

1. A method for supporting a first beam between a first support structure and a second support structure in a building frame structure, the method comprising:

providing a first console to extend from the inside of the first support structure to the outside of the first support structure so that the first console has a first free end and a beam supporting surface between the first support structure and the first free end of the first console, providing the first beam with a supporting slot extending from a first end of the first beam at a lower side of the first beam, supporting the first end of the first beam at the first console so that the first console is partly received in the supporting slot of the first beam and so that the first end of the first beam is supported on the beam supporting surface of the first console, supporting a second end of the first beam at the second support structure, and securing the first beam to the first console against movement along the first console by means of a mechanical joint between the first console and the first beam, wherein:

by providing the first console at a location between the beam supporting surface of the first console and the mechanical joint with a deforming section having increased deformability compared to the deformability of the first console at the beam supporting surface by providing reduced material dimensions in the deforming section of the first console compared to the material dimensions of the first console at the beam supporting surface, and the first beam is a hollow steel beam having a horizontal inner space.

2. The method according to claim 1, wherein the first support structure is a column.

3. The method according to claim 1, wherein the first support structure is a hollow column having a vertical inner space.

4. The method according to claim 3, further comprising filling the vertical inner space of the first support structure with concrete to form a steel-concrete composite column of the first support structure and of concrete.

5. The method according to claim 1, further comprising filling the horizontal inner space of the first beam with concrete to form a steel-concrete composite beam of the first beam and of concrete.

6. The method according to claim 1, wherein the securing the first beam to the first console against movement along the first console by means of the mechanical joint includes providing the supporting slot with an indentation and by providing the first console with a protrusion that extends from the first console into the indentation of the supporting slot.

7. The method according to claim 6, wherein the providing the protrusion includes providing the first free end of the first console with a console end plate that extends in the transversal direction of the first console beyond the first console, and the method further includes providing the indentation of the supporting slot at the end of the supporting slot so that the indentation extend in the transversal direction of the first beam in two opposite directions.

8. The method according to claim 1, further comprising using external fastening means in the mechanical joint.

9. The method according to claim 1, wherein the first console that is provided has essentially the same outer cross section between the beam supporting surface and the first free end of the first console, and the method further includes providing at least one first hole in the first console to reduce the material dimensions in first console to provide the deforming section.

10. The method according to claim 1, wherein the first console that is provided has essentially the same outer cross section between the beam supporting surface and the first free end of the first console except for the deforming section, where the first console comprises at least one section with reduced cross-sectional area in at least one of an upper surface and a lower surface of the first console to provide the deforming section.

11. The method according to claim 10, further comprising providing at least one first hole in the deforming section.

12. The method according to claim 9, further comprising arranging a reinforcement bar to pass through said at least one first hole.

13. An arrangement for supporting a first beam between a first support structure and a second support structure in a building frame structure, wherein the arrangement comprises a first console extending from the inside of the first support structure to the outside of the first support structure so that the first console has a first free end and a beam supporting surface between the first support structure and the first free end of the first console, wherein the first beam has a supporting slot extending from a first end of the first beam at a lower side of the first beam, wherein the first end of the first beam is supported at the first console so that the first console is partly is received in the supporting slot of the first beam and so that the first end of the first beam is supported on the beam supporting surface of the first console, and wherein a second end of the first beam is supported at the second support structure, wherein the first beam is secured to the first console against movement along the first console by means of a mechanical joint between the first console and the first beam, wherein by the first console at a location between the beam supporting surface of the first console and the mechanical joint being provided with a deforming section having increased deformability compared to the deformability of the first console at the beam supporting surface by reduced material dimensions being provided in said deforming section of the first console compared to the material dimensions of the first console at the beam supporting surface, and wherein the first beam is a hollow steel beam having a horizontal inner space.

14. The arrangement according to claim 13, wherein the first support structure is a column.

15. The arrangement according to claim 13, wherein the first support structure is a hollow column having a vertical inner space.

16. The arrangement according to claim 15, wherein the vertical inner space of the first support structure is filled with concrete to form a steel-concrete composite column of the first support structure and of concrete.

17. The arrangement according to claim 13, wherein the horizontal inner space of the first beam is filled with concrete to form a steel-concrete composite beam of the first beam and of concrete.

18. The arrangement according to claim 13, wherein the mechanical connection between the first console and the first beam securing the first beam to the first console against movement along the first console comprises an indentation in the supporting slot and a protrusion at the first console, wherein the protrusion extends from the first console into the indentation in the supporting slot.

19. The arrangement according to claim 18, wherein the protrusion is provided by providing the first free end of the first console in the form a console end plate that extends in the transversal direction of the first console beyond the first console, and the indentation of the supporting slot is provided at the end of the supporting slot so that the indentation extends in the transversal direction of the first beam in two opposite directions.

20. The arrangement according to claim 13, further comprising external fastening means in the mechanical joint.

21. The arrangement according to claim 13, wherein the first console has essentially the same outer cross section between the beam supporting surface and the first free end of the first console, and at least one first hole is provided in the first console to reduce the material dimensions in first console to provide the deforming section.

22. The arrangement according to claim 13, wherein the first console has essentially the same outer cross section between the beam supporting surface and the first free end of the first console except for the deforming section, where the first console comprises at least one section with reduced cross-sectional area in at least one of an upper surface and a lower surface of the first console to provide the deforming section.

23. The arrangement according to claim 22, wherein at least one first hole is provided in the deforming section.

24. The arrangement according to claim 21, wherein a reinforcement bar is arranged to pass through said at least one first hole.

25. The method according to claim 8, wherein the external fastening means are bolts.

26. The arrangement according to claim 20, wherein the external fastening means are bolts.

* * * * *